US005259991A

United States Patent [19]

Kobayashi et al.

[11] Patent Number: 5,259,991

[45] Date of Patent: Nov. 9, 1993

[54] METHOD FOR THE PREPARATION OF A POSITIVELY TEMPERATURE-DEPENDENT ORGANIC RESISTOR

[75] Inventors: Nobuo Kobayashi, Tokyo; Hiroshi Sakai, Ichikawa, both of Japan

[73] Assignee: TDK Corporation, Tokyo, Japan

[21] Appl. No.: 437,542

[22] Filed: Nov. 16, 1989

[30] Foreign Application Priority Data

Nov. 22, 1988 [JP] Japan ..... 63-293503

[51] Int. Cl.[5] ..... H01B 1/00; H01B 1/20; H01B 1/24

[52] U.S. Cl. ..... 252/511; 252/500; 252/502; 252/504; 252/510

[58] Field of Search ..... 252/500, 504, 502, 510, 252/511

[56] References Cited

U.S. PATENT DOCUMENTS

| | | | |
|---|---|---|---|
| 4,054,540 | 10/1977 | Michalchik | 252/512 |
| 4,315,237 | 2/1982 | Middleman et al. | 338/22 R |
| 4,545,926 | 10/1985 | Fouts, Jr. et al. | 252/511 |
| 4,680,140 | 7/1987 | Kageyama | 252/512 |
| 4,806,594 | 2/1989 | Gross et al. | 525/64 |
| 4,880,577 | 11/1989 | Okita et al. | 264/22 |
| 5,106,538 | 4/1992 | Barma et al. | 252/511 |
| 5,106,540 | 4/1992 | Barma et al. | 252/511 |
| 5,135,980 | 8/1992 | Watanabe | 524/496 |
| 5,143,650 | 9/1992 | Gerace et al. | 252/511 |

*Primary Examiner*—Paul Lieberman
*Assistant Examiner*—Michael Tierney
*Attorney, Agent, or Firm*—Henry T. Burke

[57] ABSTRACT

An improved positively temperature-dependent organic resistor, which is basically a composite consisting of a matrix phase of a synthetic resin and a dispersed phase of electroconductive particles, can be prepared by compounding a crystalline synthetic resin, carbon black, an organosilane compound having at least one alkoxy or alkoxy-substituted alkoxy group in a molecule and an organic peroxide, shaping the resin composition into the form of a resistor and heating the shaped body in contact with an aqueous medium containing a hydrolysis-condensation catalyst for the organosilane compound. As compared with resistors prepared by conventional methods, the resistor obtained by the inventive method is highly stable in the resistivity even after many times of repeated voltage loading.

7 Claims, 1 Drawing Sheet

FIGURE
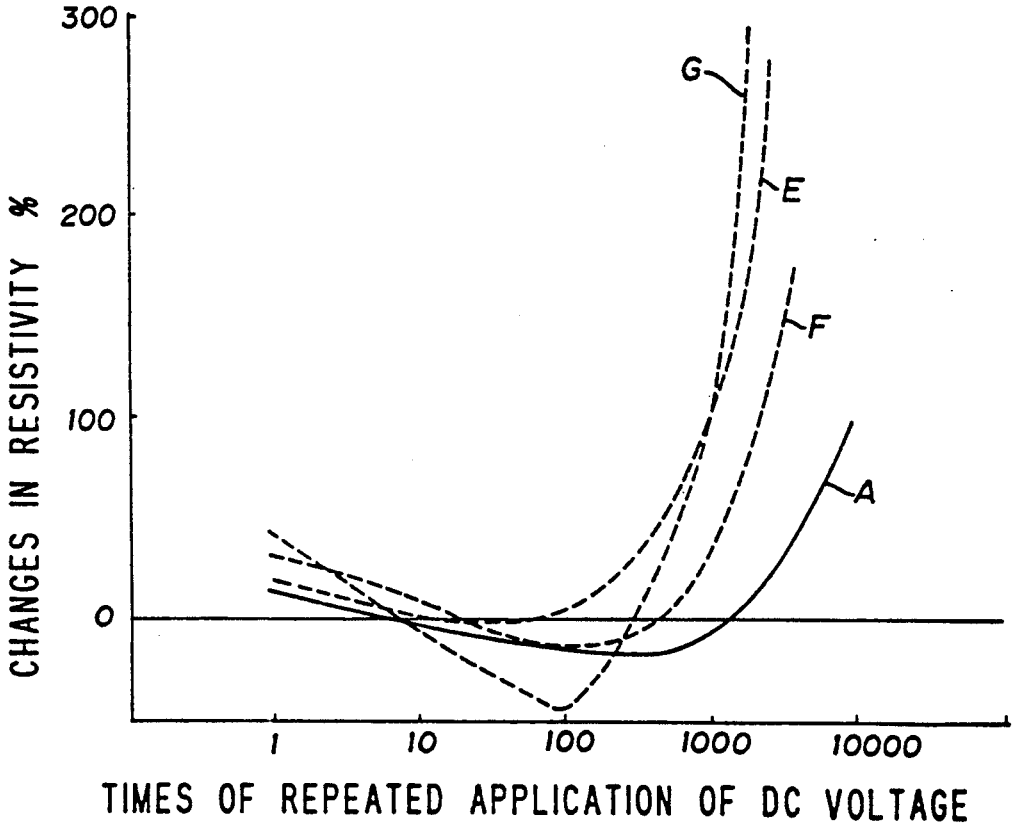

METHOD FOR THE PREPARATION OF A POSITIVELY TEMPERATURE-DEPENDENT ORGANIC RESISTOR

BACKGROUND OF THE INVENTION

The present invention relates to a method for the preparation of a positively temperature-dependent organic resistor, i.e. an organic resistor material having positive temperature-dependency of the resistivity. More particularly, the invention relates to a method for the preparation of a positively temperature-dependent organic resistor by effecting a crosslinking reaction in a blend of a crystalline synthetic resin and electroconductive particles by using a specific crosslinking agent.

It is known that an organic resistor prepared by dispersing electroconductive particles in the matrix of a crystalline synthetic resin has positive temperature dependency of the resistivity. Positively temperature-dependent organic resistors of this type generally have a problem that melting of the matrix resin may take place when the resistor is used at a relatively high temperature or the matrix resin is subject to degradation in the lapse of time. The problem due to melting of the matrix resin can be solved by crosslinking the resin so that the positive temperature coefficient of the resistivity can be maintained even at a temperature higher than the melting point of the uncrosslinked matrix resin. Crosslinking of a synthetic resin is carried out usually by the method of irradiation with electron beams or by the chemical method using an organic peroxide as a crosslinking agent (see, for example, U.S. Pat. No. 3,351,882).

These conventional methods, however, have respective disadvantages. For example, the crosslinking method by electron beam irradiation has a problem that the resistivity of the resistor prepared by this method is subject to a gradual change when the resistor is used repeatedly in addition to the economical disadvantage due to the very high costs for the facilities to conduct electron beam irradiation. The chemical crosslinking method is also defective because, in addition to the problem that the resistivity of the resistor prepared by the method is also subject to gradual changes by the repeated use of the resistor, the crosslinking reaction may proceed already in the blending step of the crystalline synthetic resin and the electroconductive particles affecting the uniformity of dispersion of the particles in the matrix so that the resistor prepared by this method sometimes has an increased resistance unless the volume fraction of the electroconductive particles is increased so much.

SUMMARY OF THE INVENTION

The present invention accordingly has an object to provide a novel method for the preparation of a positively temperature-dependent organic resistor free from the above described problems and disadvantages in the prior art methods, by which an organic resistor having a resistivity with stability even by repeated use can be prepared without the problem of the increase in the resistance of the materials due to the premature crosslinking in the course of blending and with outstandingly low costs as a consequence of the very small consumption of electric energy.

Thus, the method of the present invention for the preparation of a positively temperature-dependent organic resistor comprises the steps of:

(a) blending a crystalline synthetic resin with an electroconductive inorganic powder, an organosilane compound having at least one alkoxy group or alkoxy-substituted alkoxy group in a molecule and an organic peroxide to form a resin blend;

(b) shaping the resin blend into a form of a resistor; and (c) heating the shaped form of the resistor in contact with an aqueous medium containing a hydrolysis-condensation catalyst for the organosilane compound.

BRIEF DESCRIPTION OF THE DRAWING

The FIGURE is a graphic showing of the changes in the resistivity of the resistors prepared in Example 2 and Comparative Example as a function of the times of repeated application of a DC voltage.

DETAILED DESCRIPTION OF THE PREFERRED EMBODIMENTS

As is described above, the inventive method is characteristic in the compounding of a specific orgnaosilane compound as a crosslinking agent and an organic peroxide with a resin composition composed of a crystalline synthetic resin and an electroconductive inorganic powder and a heat treatment of the shaped body of the resin composition while it is in contact with an aqueous medium containing a catalytic compound to effect crosslinking of the synthetic resin.

The matrix phase of the organic resistor prepared by the inventive method is a crystalline synthetic resin which is, as is disclosed in U.S. Pat. No. 3,243,753, exemplified by polyolefins such as high-density polyethylene and polypropylene, nylons such as nylon-6 and nylon-66, polyacetals, polymers of halogenated olefins such as poly(vinyl chloride), poly(vinylidene chloride), poly(vinylidene fluoride) and poly(tetrafluoro ethylene), polyesters such as poly(ethylene terephthalate) and so on, of which high-density polyethylene and poly(vinylidene fluoride) are particularly preferred. It is desirable that the resin should have a thermal expansion coefficient as large as possible.

The electroconductive inorganic powder or filler compounded with the above mentioned crystalline synthetic resin is exemplified by carbon black, non-oxide compounds of a metal such as titanium carbide, boron carbide, chromium carbide, zirconium carbide, titanium boride, titanium nitride and zirconium nitride and powders of a metal such as aluminum and copper, of which carbon black is particularly preferred. The carbon black is not particularly limitative in respect of the types and grades but those having an average particle diameter of 0.003 to 1.0 μm or, preferably, 0.01 to 0.1 μm are used quite satisfactorily.

The organosilane compound used as a crosslinking agent should have at one to three or, preferably, three alkoxy groups or alkoxy-substituted alkoxy groups in a molecule. In addition, the organosilane compound should have a monovalent hydrocarbon group substituted with a functional group such as vinyl, epoxy, amino and mercapto groups. Examples of suitable organosilane compound include vinyl silanes such as vinyl trimethoxy silane, vinyl triethoxy silane and vinyl (β-methoxyethoxy)silane, epoxy-containing silanes such as 2-(3,4-epoxy cyclohexyl)ethyl trimethoxy silane, amino-containing silanes such as 3-aminopropyl triethoxy silane and mercapto-containing silanes such as 3-mercaptopropyl trimethoxy silane. In particular, vinyl silanes such as vinyl trimethoxy silane, vinyl triethoxy silane and the like are preferred among the above named silane coupling agents.

The organic peroxide acts as a grafting agent for the above described organosilane compound on to the molecules of the crystalline synthetic resin. Examples of suitable organic peroxides include dicumyl peroxide, 1,3-bis(tert-butylperoxy isopropyl) benzene and the like though not particularly limited thereto.

In practicing the method of the present invention, the crystalline synthetic resin is compounded with an electroconductive inorganic filler, an organosilane compound as a crosslinking agent and, preferably, an organic peroxide as a grafting agent for the organosilane compound to the synthetic resin and the thus obtained resin composition is shaped into a form of a desired resistor.

The amount of the electroconductive inorganic filler in the resin composition is usually in the range from 10 to 70% by weight or, preferably, from 30 to 50% by weight based on the crystalline synthetic resin when the filler is a carbon black. When the amount of the electroconductive filler is too small, the resistor would not be imparted with adequate electroconductivity while, when the amount thereof is too large, the temperature coefficient of the resistivity would be unduly decreased.

The amount of the organosilane compound as a crosslinking agent in the resin composition is usually in the range from 0.01 to 20% by weight or, preferably, from 1 to 10% by weight based on the amount of the crystalline synthetic resin. When the amount of the organosilane compound is too small, the crosslinking density of the resin composition in the shaped resistor cannot be high enough so that the mechanical strength of the resistor may be poor. No further increase in the crosslinking density can be obtained, however, even by increasing the amount of the organosilane compound over the above mentioned upper limit rather with an eventual decrease in the temperature coefficient of the resistor shaped from the resin composition.

The amount of the organic peroxide such as dicumyl peroxide, 1,3-bis(tert-butylperoxy isopropyl)benzene and the like compounded with the resin composition is in the range from 0.1 to 2% by weight based on the amount of the crystalline synthetic resin.

The resistor-formed shaped body of the above described resin composition is then brought into contact with an aqueous medium such as water and a water-containing organic solvent which should contain a hydrolysis-condensation catalyst for the organosilane compound. Examples of suitable catalytic compounds include metal carboxylates such as dibutyl tin dilaurate, dioctyl tin dilaurate, tin acetate, tin octoate, lead naphthenate, lead octoate and the like and organic titanium compounds such as titanate ester compounds and titanium-containing chelate compounds, of which dibutyl tin dilaurate is particularly preferred. The hydrolysis-condensation reaction of the organosilane compound to effect crosslinking is performed at a temperature in the range from 25° to 100° C. or, preferably, in the range from 60° to 80° C. and the reaction is complete usually within 1 to 100 hours or, in most cases, within 24 to 48 hours. It is a possible way that the aqueous medium is heated at a temperature higher than 100° C. by pressurization so as to accelerate the reaction. When the reaction is complete, the crosslinking density in the resin composition is sufficiently high to minimize the thermal deformability of the resistor.

The positively temperature-dependent organic resistor prepared according to the inventive method is thermally very stable and suffers little from the changes in the resistivity even by many times of repeated use or application of a voltage. For example, a comparative test was undertaken to determine the number of intermittent loading cycles by which the resistivity of a resistor was doubled as compared with the initial value for the resistors prepared according to the inventive and conventional methods. Each of the loading cycles consisted of 10 seconds of impression of DC 10 volts in the direction of the thickness to a resistor of 10 mm diameter and a 0.7 mm thickness and 30 seconds of a repose time at an ambient temperature of 25° C. The results were that the numbers of the loading cycles on the resistors prepared by the conventional chemical crosslinking method, electron beam-irradiation method and inventive method were 500 to 1000 times, 500 to 2000 times and more than 10,000 times, respectively, with no significant changes in the temperature coefficient of the resistivity. In addition to the above mentioned outstandingly high stability of the resistivity by repeated use, the resistor prepared according to the inventive method can be imparted with high electroconductivity as compared with conventional resistors by virtue of the absence of the undesirable phenomenon of increace in the resistance of the resin composition during the blending works so that the resistors prepared by the inventive method are useful also as an overcurrent protecting element, heater element and the like manufactured with low costs due to the small consumption of electric energy and small investment for the production facilities.

In the following, the method of the present invention is described in more detail by way of examples.

EXAMPLE 1

A resin composition was prepared by blending, in a kneader, 100 g of a high-density polyethylene and 30 g of a carbon black having an average particle diameter of 0.025 μm followed by the addition of 5 g of vinyl trimethoxy silane in which 0.5 g of dicumyl peroxide had been dissolved in advance. The resin composition was shaped into a sheet of 1 mm thickness. The sheet was heated at 80° C. for 24 hours in a sufficient volume of an aqueous suspension containing 10% by weight of dibutyl tin dilaurate dispersed therein in an emulsified state under irradiation with ultrasonic waves to effect the hydrolysis-condensation reaction of the organosilane compound.

The thus prepared resistor sheet had a volume resistivity of 10 ohm·cm at 25° C. and the temperature coefficient of the volume resistivity was 200%/°C. Further, a loading cycle test of the resistor sheet was performed under the conditions described above to determine the number of the loading cycles by which a change of 50% or more took place in the volume resistivity. The results were that the changes in the resistivity were: +12.5% after 100 cycles; −7.0% after 500 cycles; −6.0% after 1000 cycles; −3.8% after 2000 cycles; +5.0% after 5000 cycles; +22% after 10,000 cycles; and +63% after 50,000 cycles.

EXAMPLE 2 AND COMPARATIVE EXAMPLE

A sheet-like resistor body was prepared in just the same manner as in Example 1 except that the amount of vinyl trimethoxy silane was decreased to 2 g. The thus prepared resistor sheet was subjected to the loading cycle test for the changes in the volume resistivity by the repeated application of a DC voltage in the same manner as before to give the results shown in the FIGURE of the accompanying drawing by the curve A of the graph. The initial values of the volume resistivity and the temperature coefficient of the resistivity of this resistor sheet were 8 ohm·cm and 100%/°C., respectively.

For comparison, three resistor sheets were prepared each in about the same manmer as in Example 1 by omitting the vinyl trimethoxy silane and using 0.5 g, 1 g or 3 g of dicumyl peroxide. The results of the loading cycle tests for the resistivity change in these comparative resistor sheets are shown in the graph of the FIGURE by the curves E, F and G for the amount of dicumyl peroxide of 0.5 g, 1 g and 3 g, respectively.

The values of the initial volume resistivity and the temperature coefficient of the resistivity of these three comparative resistor sheets were: 8 ohm·cm and 100%/°C.; 10 ohm·cm and 200 to 300%/°C.; and 20 ohm·cm and 20%/°C., respectively.

As is understood from the graph in the FIGURE, a noticeable change in the resistivity could be found in the resistor prepared according to the inventive method only after 2000 to 5000 cycles of repeated voltage loading while a rapid increace in the resistivity had started in the comparative resistor sheets already after 1000 cycles or less of the repeated voltage loading.

EXAMPLE 3

A resistor sheet was prepared in substantially the same manner as in Example 1 except that the resin composition for shaping of the resistor sheet was compounded with 100 g of a poly(vinylidene fluoride) resin, 30 g of the same carbon black as in Example 1 and 10 g of vinyl tris(β-methoxyethoxy) silane containing 1 g of 1,3-bis(tert-butylperoxy isopropyl) benzene dissolved therein. The thus prepared resistor sheet had a volume resistivity of 2 ohm·cm at 25° C. and the temperature coefficient thereof was 200%/°C. The results of the loading cycle test for the resistivity changes by repeated DC voltage application were: −2.0% after 100 cycles; −1.7% after 1000 cycles; −1.4% after 5000 cycles; +6.0% after 10,000 cycles; and +28% after 20,000 cycles.

What is claimed is:

1. A method for the preparation of a positively temperature-dependent organic resistor which comprises the steps of:

(a) blending a crystalline synthetic resin with from about 10 to about 70% by weight based on the weight of the crystalline synthetic resin of an electro-conductive inorganic powder, from about 0.01 to about 20% by weight based on the amount of the crystalline synthetic resin of an organosilane compound having at least one alkoxy group or alkoxy-substituted alkoxy group in the molecule, and from about 0.1 to about 2% by weight based on the amount of the crystalline synthetic resin of an organic peroxide, to form a resin blend;

(b) shaping the resin blend into a form of a resistor; and (c) heating the shaped form of the resistor in contact with an aqueous medium containing a hydrolysis-condensation catalyst for the organosilane compound.

2. The method for the preparation of a positively temperature-dependent organic resistor as claimed in claim 1 wherein the crystalline synthetic resin is a high-density polyethylene or a poly(vinylidene fluoride).

3. The method for the preparation of a positively temperature-dependent organic resistor as claimed in claim 1 wherein the electro-conductive inorganic powder is carbon black.

4. The method for the preparation of a positively temperature-dependent organic resistor as claimed in claim 1 wherein the organosilane compound is vinyl trimethoxy silane, vinyl triethoxy silane or vinyl tris(β-methoxyethoxy) silane.

5. The method for the preparation of a positively temperature-dependent organic resistor as claimed in claim 1 wherein the organic peroxide is dicumyl peroxide or 1,3-bis(tertbutylperoxy isopropyl) benzene.

6. The method for the preparation of a positively temperature-dependent organic resistor as claimed in claim 1 wherein the hydrolysis-condensation catalyst is dibutyl tin dilaurate.

7. The method for the preparation of a positively temperature-dependent organic resistor as claimed in claim 1 wherein the heat treatment in step (c) is performed at a temperature in the range from 25° to 100° C. for 1 to 100 hours.

* * * * *